US007212758B2

(12) United States Patent
Kishi et al.

(10) Patent No.: US 7,212,758 B2
(45) **Date of Patent: *May 1, 2007**

(54) IMAGE-FORMING APPARATUS

(75) Inventors: Kazuhito Kishi, Kanagawa (JP); Yasuhisa Kato, Kanagawa (JP); Akiyasu Amita, Kanagawa (JP); Masami Okamoto, Kanagawa (JP); Yasutada Tsukioka, Chiba (JP); Hiromasa Takagi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/402,950

(22) Filed: Apr. 13, 2006

(65) Prior Publication Data

US 2006/0182460 A1 Aug. 17, 2006

Related U.S. Application Data

(63) Continuation of application No. 10/809,378, filed on Mar. 26, 2004, now Pat. No. 7,054,570.

(30) Foreign Application Priority Data

Mar. 27, 2003 (JP) ..... 2003-087235

(51) Int. Cl.
*G03G 15/20* (2006.01)

(52) U.S. Cl. ..... 399/67; 399/37

(58) Field of Classification Search ..... 399/33, 399/37, 67, 69, 70, 88, 320; 219/216, 469, 219/470, 471; 347/156
See application file for complete search history.

(56) References Cited

U.S. PATENT DOCUMENTS 6,542,705 B2 4/2003 Fujita et al. ..... 399/69
7,054,570 B2 * 5/2006 Kishi et al. ..... 399/67
2002/0043523 A1 4/2002 Fujita et al. ..... 219/216
2004/0245241 A1 12/2004 Kishi et al. ..... 219/494
2004/0247334 A1 12/2004 Kishi et al. ..... 399/69

FOREIGN PATENT DOCUMENTS

| | | |
|---|---|---|
| JP | 63-210979 A | 9/1988 |
| JP | 03-036579 | 2/1991 |
| JP | 10-10913 | 1/1998 |
| JP | 10-282821 | 10/1998 |
| JP | 2002-184554 | 6/2002 |
| JP | 2002-280146 | 9/2002 |
| JP | 2003-297526 | 10/2003 |

OTHER PUBLICATIONS

U.S. Appl. No. 11/544,674, filed Oct. 10, 2006, Kishi et al.

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image-forming apparatus is disclosed. The image-forming apparatus includes a fixing unit. The fixing unit includes: a heating part including a heating element; a power storage unit including a chargeable and dischargeable capacitor and supplying power to the heating part so that the heating element of the heating part generates heat; and a controller controlling the operation of the power storage unit. When the image-forming operation of the image-forming apparatus is suspended by an abnormality, the controller performs control such that the capacitor is charged in accordance with its remaining amount of stored energy.

3 Claims, 3 Drawing Sheets

IMAGE-FORMING APPARATUS

BACKGROUND OF THE INVENTION

1. Field of the Invention

The present invention generally relates to image-forming apparatuses, and more particularly to an image-forming apparatus such as an electrophotographic copier, printer, or facsimile machine using a fixing unit including a power storage unit.

2. Description of the Related Art

Many image-forming apparatuses such as copiers, which form an image on a recording medium such as plain paper or an OHP sheet, employ electrophotography in terms of image formation speed, image quality, and cost. According to electrophotography, a toner image is formed on a recording medium, and the formed toner image is fixed on the recording medium by heat and pressure. At present, heat roller fixing is most commonly employed as a fixing method for safety reasons. According to heat roller fixing, a heating roller applying heat using a heating member such as a halogen heater and a pressure roller provided opposite the heating roller are pressed against each other so as to form a so-called nip part where the heating roller and the pressure roller are in press contact with each other. The recording medium on which the toner image has been transferred passes through the nip part to be heated and pressed. As a result, the toner image is fixed on the recording medium.

An increasing importance of environmental issues in recent years has caused the image-forming apparatuses such as copiers and printers to have more advanced energy-saving features. When energy saving in the image-forming apparatuses is considered, power saving in a fixing unit fixing toner on a recording medium cannot be ignored. According to a commonly employed method to reduce power consumption in the fixing unit during the stand-by state of the image-forming apparatus, the heating roller is maintained at a certain temperature slightly lower than a temperature for fixing during the stand-by state. When the fixing unit is used, the temperature of the heating roller is raised immediately to an enabling temperature at which the heating roller becomes usable. As a result, a user does not have to wait for the rise of the temperature of the heating roller. This method requires a certain amount of power to be supplied even when the fixing unit is not being used, thus consuming extra energy. It is believed that the energy consumption during the stand-by state corresponds to approximately 70 to 80% of the energy consumption of the components of the image-forming apparatuses.

Therefore, there is an increasing demand for further power saving by reducing energy consumption during the stand-by state. It is desired that no power be supplied when the fixing unit is not in use. However, if no energy is to be consumed during the stand-by state, it takes a few to more than ten minutes before the heating roller of the fixing unit rises to an enabling temperature of approximately 180° C. This is because a metal roller of iron or aluminum is mainly used as the heating roller, and thus the heating roller has a large thermal capacity. Such a wait period decreases user-friendliness. Accordingly, a heating method that consumes as little power as possible while realizing quick activation from a stand-by state is desired.

A period for the temperature of the heating roller to rise may be reduced by increasing input energy per unit time, that is, rated power. Many image-forming apparatuses performing high-speed printing, referred to as high-speed machines, support a supply voltage of 200 V. In Japan, however, commercial power for offices is normally 100 V and 15 A, and special modifications have to be made to the power supply-related facilities of the locations of installation of image-forming apparatuses to support the supply voltage of 200 V. Accordingly, supporting the supply voltage of 200 V is not very common as a solution to this issue.

That is, an attempt may be made to raise the temperature of the heating roller in a short period of time, but maximum input energy is determined by power supply as far as the commercial power supply of 100 V and 15 A is employed. In order to improve this situation, a voltage lower by a certain level is applied to the heating roller to delay the falling of the temperature of the fixing unit when the fixing unit enters a stand-by state (for instance, Japanese Laid-Open Patent Application No. 10-010913). Alternatively, a secondary battery as secondary power supply is charged during the stand-by state of the fixing unit, and when the fixing unit is started up, power is supplied from a primary power supply unit as well as the secondary battery or a primary battery so as to reduce startup time (for instance, Japanese Laid-Open Patent Application No. 10-282821).

According to the technique disclosed in JP10-010913, however, a voltage lower by a certain level is supplied to the fixing unit even during its stand-by state. Thus, it is considered that power saving is insufficient. Further, this technique does not focus mainly on making maximum power supply at the time of activating the fixing unit larger than power supply from a primary power supply unit. On the other hand, according to JP10-282821, when the fixing unit is started up, power is supplied thereto from the primary power supply unit and the primary or secondary battery. Generally, a lead storage battery, a nickel-cadmium battery, or a nickel-hydrogen battery may be used as the secondary battery. The characteristics of the secondary battery are such that its capacity is deteriorated and reduced by repeated charging and discharging and that its useful service life becomes shorter as a discharge current becomes larger. Further, there is also the phenomenon of capacity reduction due to the memory effect. Generally, even a secondary battery considered as having a longer useful service life against a large discharge current can only be charged and discharged approximately 500 to 1000 times. That is, if charging and discharging of such a secondary battery is repeated 20 times a day, the useful service life of the secondary battery comes to an end in a month or so. This increases the frequency of changing secondary batteries, thus taking time, causing trouble, and increasing running costs such as the cost of batteries to be changed. Further, a lead storage battery, which uses liquid sulfuric acid as an electrolyte, is not preferable for use in office equipment.

Further, there is also a problem in that a sudden current change or an in-rush current at the time of starting or stopping the supply of high power increases a load on a circuit for heating housed in the heating roller and causes an input current to flow through peripheral circuits, thus causing noise. Accordingly, it is not preferable to frequently switch on and off the supply of power from a large-capacity (high power level) secondary power supply. Further, supplying high power at a time may result in the oversupply of power, thus causing the temperature of the heating circuit to rise excessively.

As a fixing unit improved in the above-described points that can be more effective in power saving, reduce noise due to a sudden current change or an in-rush current at the time of starting or stopping the supply of high power, and prevent an excessive rise in temperature by reducing startup time, Japanese Laid-Open Patent Application No. 2002-184554, for instance, proposes a device in which: a chargeable and dischargeable capacitor is employed in a secondary power supply unit; a charger charges the capacitor of the secondary power supply unit with power supplied from a primary power supply unit; a switching unit performs switching between the charging of the secondary power supply unit and the supplying of power from the secondary power supply unit to a secondary heating element (heater); and the power supplied from the secondary power supply unit to the secondary heating element is controlled.

The device disclosed in JP2002-184554 includes a primary heater caused to generate heat by power supplied from a commercial power supply and the secondary heater caused to generate heat by power supplied from the secondary power supply unit including the capacitor so as to heat the heating roller of a fixing unit. The capacitor employed in the secondary power supply unit may be a chargeable and dischargeable electric double layer capacitor having a capacitance of approximately 2000 F. sufficient for power supply for a few to tens of seconds. For instance, the power supply from the secondary power supply unit to the secondary heater is controlled by being switched on and off based on timing for shutting off the power supply.

The capacitor has the basic functions of causing the secondary heater to generate heat by power supplied from the capacitor, reducing startup time required for the heating roller to reach a predetermined temperature using the generated heat, and preventing temperature for fixing (fixing temperature) from lowering at the time of paper passing through the fixing unit (paper passing operation). In actual usage, it takes some time before the temperature of a fixing roller and a fixing belt, that is, fixing temperature, lowers, and therefore, it is possible to charge the capacitor during that period. However, if such paper passing operation is performed frequently at short time intervals with a small number of paper sheets passing through the fixing unit at a time, the secondary heater is caused to generate heat every time the operation is performed, thus reducing the stored energy of the capacitor. That is, in so-called energy savers having an extremely small fixing thermal capacity, there is a tendency for the fixing roller and the fixing belt to be deprived of heat by paper, toner, and a pressure member at the time of paper passing so that the fixing temperature suddenly drops, and the temperature of the fixing roller and the fixing belt starts to recover when the pressure member has warmed up. Accordingly, it is necessary for the secondary heater supplied with power from the capacitor to start to generate heat immediately after the start of paper passing operations. As a result, the stored energy of the capacitor is reduced by repeatedly performing paper passing operations with a small number of paper sheets passing through the fixing unit at a time.

SUMMARY OF THE INVENTION

Accordingly, it is a general object of the present invention to provide an image-forming apparatus in which the above-described disadvantages are eliminated.

A more specific object of the present invention is to provide an image-forming apparatus that can constantly form excellent images during use by charging, even if intermittently, a capacitor at any time the capacitor is in a chargeable state even during image-forming operations.

The above objects of the present invention are achieved by an image-forming apparatus including: a fixing unit, the fixing unit including: a heating part including a heating element; a power storage unit configured to supply power to the heating part so that the heating element of the heating part generates heat, the power storage unit including a chargeable and dischargeable capacitor; and a controller configured to control an operation of the power storage unit, wherein, when image-forming operation of the image-forming apparatus is suspended by an abnormality, the controller performs control such that the capacitor is charged in accordance with a remaining amount of stored energy thereof.

The above objects of the present invention are also achieved by an image-forming apparatus including: a fixing unit, the fixing unit including: a heating part including a heating element; a power storage unit configured to supply power to the heating part so that the heating element of the heating part generates heat, the power storage unit including a chargeable and dischargeable capacitor; and a controller configured to control an operation of the power storage unit, wherein, when image-forming operation of the image-forming apparatus is stopped, the controller performs control such that the capacitor is charged in accordance with a remaining amount of stored energy thereof.

According to the present invention, if a situation allows the capacitor of the power storage unit of the fixing unit to be charged, as in the case where the image-forming apparatus stops its operation due to a detected abnormality such as a paper jam while the image-forming apparatus is in operation, the capacitor is charged, even if intermittently. This makes it possible to form an excellent image while the image-forming apparatus is in use. Further, this also makes it possible to prevent the stored energy of the capacitor from decreasing due to repeated image-forming operations each with a small number of paper sheets passing through the fixing unit.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of an embodiment of the present invention.

Figure 1:
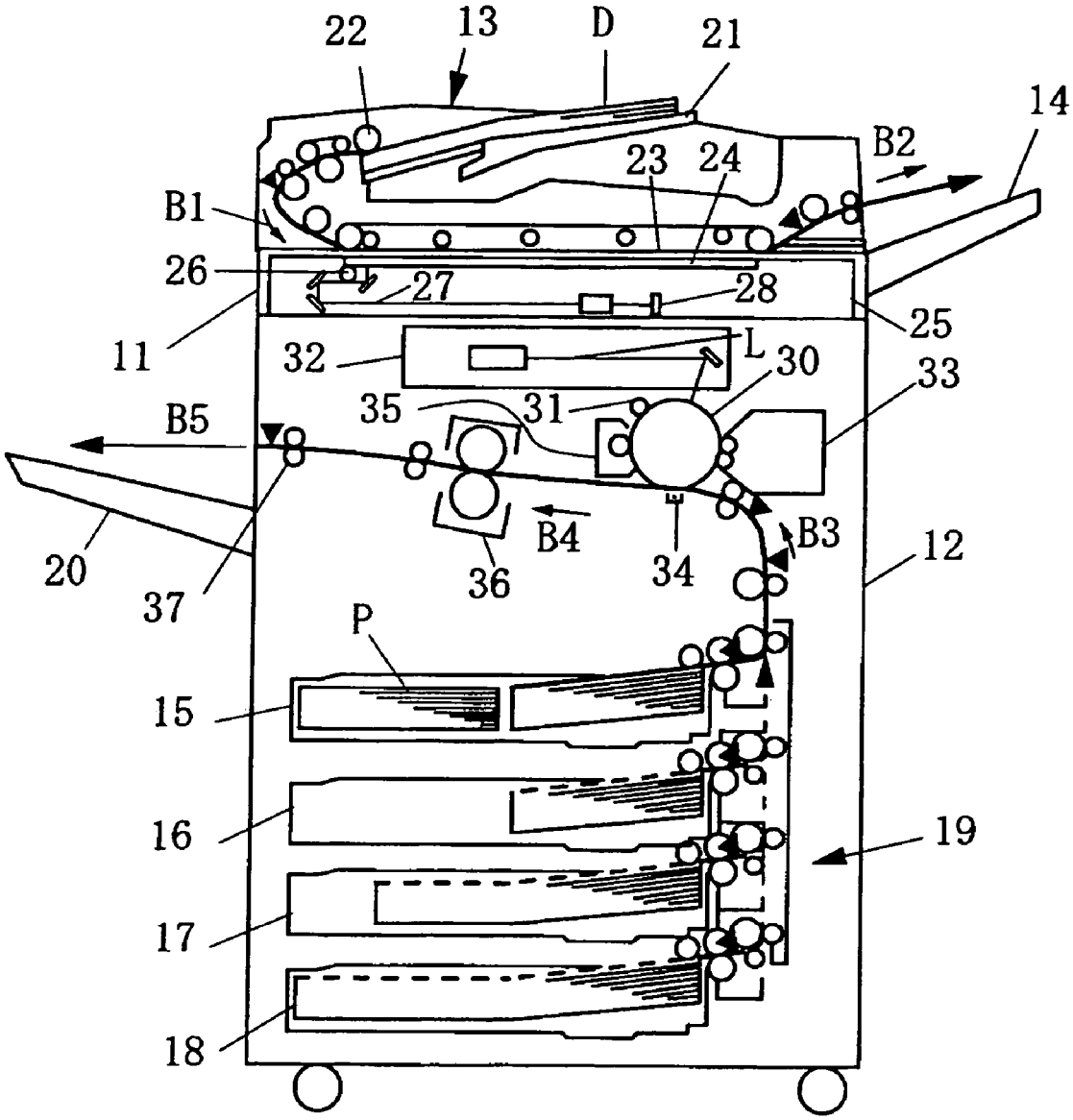
FIG. 1 is a sectional view of an image-forming apparatus according to an embodiment of the present invention.

FIG. 1 is a sectional view of an image-forming apparatus according to the embodiment of the present invention. The image-forming apparatus of FIG. 1 includes an image reading unit 11 reading an original, an image-forming part 12 forming an image, an automatic document feeder (ADF) 13, an original paper ejection tray 14 onto which the sheets of paper of the original conveyed from the ADF 13 are stacked, a paper feed part 19 including paper feed cassettes 15 through 18, and a paper ejection part (paper ejection tray) 20 onto which sheets of paper (recording media) on which recording has been performed are stacked.

When the original is set on an original table 21 of the ADF 13, and an operation part (not graphically represented) is operated (for instance, a print key is pressed), the uppermost one of the sheets of paper of the original, hereinafter referred to as an original sheet D, is conveyed in a direction indicated by arrow B1 by the rotation of a pickup roller 22. Then, the original sheet D is fed onto a contact glass 24 fixed to the image reading unit 11 by the rotation of an original conveying belt 23, and stops on the contact glass 24. The image of the original sheet D placed on the contact glass 24 is read by a reader 25 positioned between the image-forming part 12 and the contact glass 24. The reader 25 includes a light source 26 illuminating the original sheet D on the contact glass 24, an optical system 27 forming the image of the original sheet D, and a photoelectric conversion element 28 formed of a charge-coupled device (CCD) on which the image of the original sheet D is formed. After the image is read, the original sheet D is conveyed in a direction indicated by arrow B2 by the rotation of the conveying belt 23 to be ejected onto the paper ejection tray 14. Thus, the sheets of paper of the original are fed one by one onto the contact glass 14 so that the images of the original are read by the image reading unit 11.

On the other hand, inside the image-forming part 12, a photosensitive body 30 as an image carrier is disposed. The photosensitive body 30 rotates clockwise in FIG. 1, and has its surface charged with a predetermined electric potential by a charging unit 31. A writing unit 32 emits a laser beam L optically modulated in accordance with information on the image read by the reader 25 so that the charged surface of the photosensitive body 30 is exposed to the laser beam L, thereby forming an electrostatic latent image on the surface of the photosensitive body 30. The electrostatic latent image is developed into a toner image by a development unit 33. Then, the toner image is transferred by an opposing transfer unit 34 onto one of recording media P (hereinafter referred to as the recording medium P) fed into a space between the photosensitive body 30 and the transfer unit 34. The surface of the photosensitive body 30 from which the toner image has been transferred is cleaned by a cleaning unit 35.

The recording media P such as sheets of paper are stored in the paper feed cassettes 15 through 18 disposed in a lower part of the image-forming part 12. The recording medium P is conveyed in a direction indicated by arrow B3 from any of the paper feed cassettes 15 through 18, and the toner image formed on the surface of the photosensitive body 30 is transferred onto the surface of the recording medium P as described above. Next, the recording medium P is caused to pass through a fixing unit 36 inside the image-forming part 12 as indicated by arrow B4 so that the toner image transferred onto the surface of the recording medium P is fixed thereon by the action of heat and pressure. The recording medium P having passed through the fixing unit 36 is conveyed by a pair of paper ejection rollers 37 to be ejected onto the paper ejection tray 20 as indicated by arrow B5.

Figure 2:
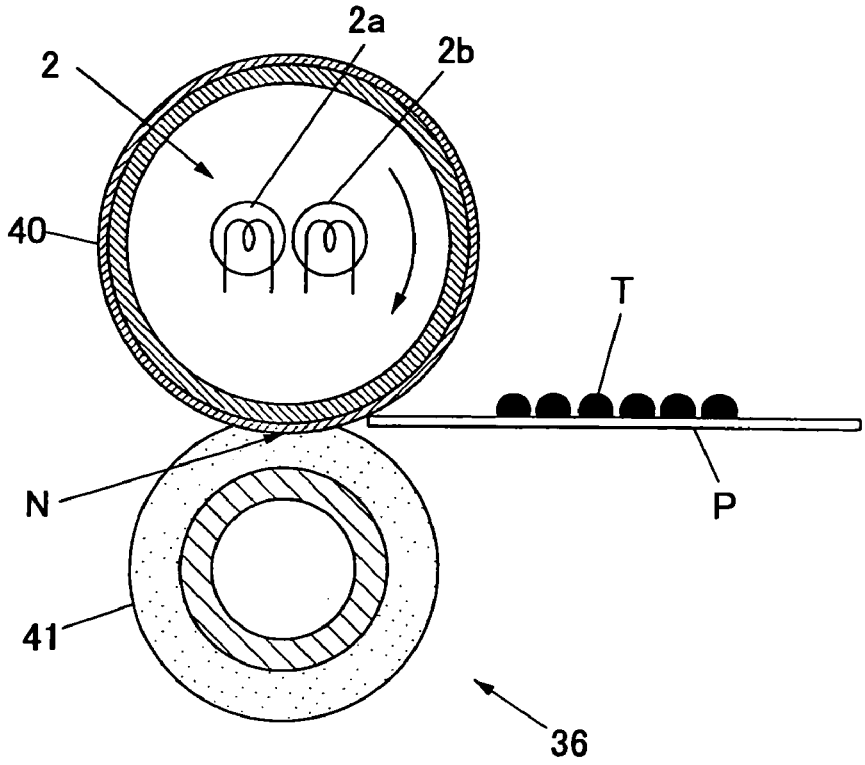
FIG. 2 is a sectional view of a fixing unit employed in the image-forming apparatus according to the embodiment of the present invention.

FIG. 2 is a sectional view of the fixing unit 36. The fixing unit 36 includes a fixing roller 40 and a pressure roller 41. The fixing roller 40 contains a heating part 2 including a primary heating element 2*a* and a secondary heating element 2*b* each formed of a halogen heater. The fixing roller 40 and the pressure roller 41 form a nip part N through which the recording medium P carrying toner T thereon passes to be pressed and heated. Although not graphically represented, a sensor detecting the temperature of the fixing roller 40 is provided in its vicinity. The fixing unit 36 may also be configured so that its ambient temperature and the temperature of the recording medium P are detected.

The recording medium P on which the toner image has been transferred (the toner T is placed) fed to the fixing unit 36 is conveyed between the fixing roller 40 and the pressure roller 41. The fixing roller 40 heated to a certain temperature heats and fuses the toner T so that the toner image (the toner T) is fixed on the recording medium P. For this purpose, power is supplied to the primary heating element 2*a* and the secondary heating element 2*b* of the heating part 2 of the fixing roller 40 so as to raise the temperature of the fixing roller 40. The power supply is controlled by being switched on and off so as to prevent the temperature of the fixing roller 40 from rising excessively. Thus, fixing temperature is maintained at a certain or desired temperature or controlled to show a desired change. As a result, the toner T is stably heated and fused so that a good toner image is fixed on the recording medium P.

Figure 3:
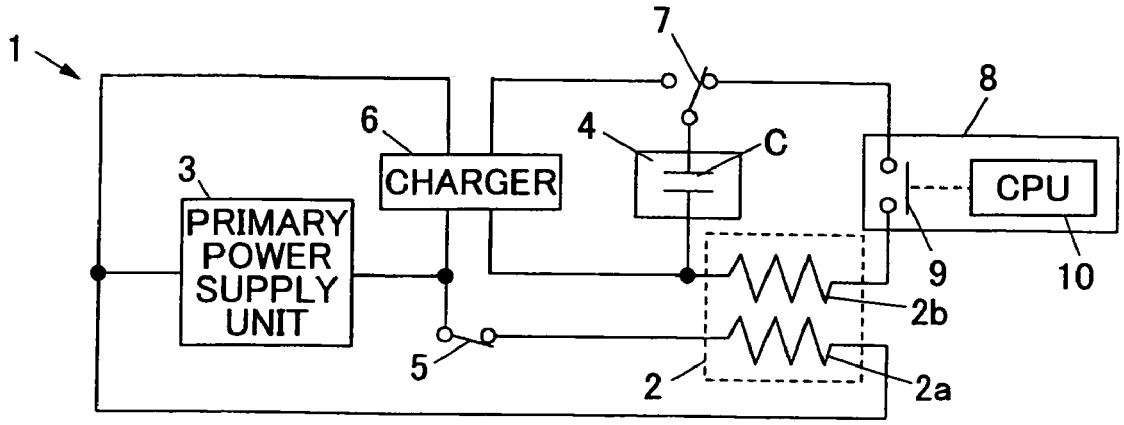
FIG. 3 is a circuit diagram showing a heating unit employed in the image-forming apparatus according to the embodiment of the present invention.

FIG. 3 is a circuit diagram showing the heating part 2 of the fixing roller 40 and a heating unit 1 supplying power to the heating part 2. The heating unit 1 employed in the image-forming apparatus includes a primary power supply unit 3, a secondary power supply unit 4, a main switch 5, a charger 6, a switching unit 7, and a controller 8.

As described above, the heating part 2 includes the primary and secondary heat elements 2*a* and 2*b* so as to heat the fixing roller 40. The primary heat element 2*a* is caused to generate heat by power supplied from the primary power supply unit 3. The secondary heat element 2*b* is caused to generate heat by power supplied from the secondary power supply unit 4. Although not graphically represented in detail, the primary power supply unit 3 is connected to, for instance, an outlet at the installation location inside the image-forming part 12 so as to receive power supply from a commercial power supply. The primary power supply unit 3 has the functions of controlling voltage in accordance with the heating part 2 and rectifying an alternating current to a direct current. Those functions are well known, and a detailed graphical representation and description thereof is omitted.

The secondary power supply unit 4 includes a chargeable and dischargeable capacitor C. The capacitor C may be a capacitor having a capacitance of, for instance, approximately 80 F., and more preferably, an electric double layer capacitor having a capacitance of approximately 2000 F. or larger sufficient for power supply for a few to tens of seconds. This is because unlike a secondary battery, capacitors including the electric double layer capacitor are not accompanied by chemical reactions, thus having excellent characteristics.

In the case of a secondary power supply unit using a nickel-cadmium battery common as a secondary battery, even rapid charging requires several hours to charge the battery. On the other hand, the capacitor C of the secondary power supply unit 4 can be charged rapidly in a few minutes. In the case where a stand-by state and a heated state are alternately entered within the same period of time with respect to a system using the secondary power supply unit using the nickel-cadmium battery and a system using the secondary power supply unit 4 using the capacitor C, by using the secondary power supply unit 4 using the capacitor C, it can be ensured that power is supplied from the secondary power supply unit 4 at the time of activating the heating part 2, thereby making it possible to raise the temperature of the heating part 2 to a predetermined value in a short period of time. The nickel-cadmium battery can tolerate approximately 500 to 1000 repetitions of charging and discharging. Accordingly, the nickel-cadmium battery has a short useful service life as a secondary power supply for heating. Therefore, time and trouble in changing the nickel-cadmium batteries and their costs become a problem. On the other hand, the secondary power supply unit 4 using the electric double layer capacitor can tolerate more than ten thousand repetitions of charging and discharging. The electric double layer capacitor is hardly degraded by repeated charging and discharging. Further, unlike a lead storage battery, the electric double layer capacitor requires no liquid replacement or replenishment. Therefore, the electric double layer capacitor hardly requires any maintenance, and thus, can be used stably for a long period of time.

The electric double layer capacitor, which includes no dielectric, uses the absorption and desorption (charging and discharging) of the ion absorption layer of each electric double layer on which the electric charges of ions or solvent molecules concentrate, the electric double layer being formed at the interface between an individual electrode and a solution. The electric double layer capacitor has excellent characteristics. For instance, the electric double layer capacitor is resistant to repeated charging and discharging, has a long useful service life, is maintenance-free, is eco-friendly, and has high charging and discharging efficiency. Recently, electric double layer capacitors having larger capacities have been developed, such as those having a capacitance of tens of thousands of farads and an energy density of more than 10 Wh/I.

The main switch 5 switches on and off power supply from the primary power supply unit 3 to the primary heating element 2*a*. The charger 6 charges the capacitor C of the secondary power supply unit 4 with power supplied from the primary power supply unit 3. The switching unit 7 performs switching between the charging of the secondary power supply unit 4 and the supplying of power from the secondary power supply unit 4 to the secondary heating element 2*b*.

The controller 8 includes a switch 9 and a CPU 10. The controller 8 performs control operations such as the switching on and off of power supply from the secondary power supply unit 4 to the secondary heating element 2*b* based on below-described preset conditions. The controller 8 of FIG. 3 shows one of a variety of employable configurations therefor. Further, the connection mode for controlling the secondary power supply unit 4 is not limited to the graphically represented configuration. For instance, control operation such as the switching on and off of power supply from the secondary power supply unit 4 to the secondary heating element 2*b* may be performed by operating the switching unit 7.

Next, a description is given of basic operations of the heating unit 1 having the above-described configuration. First, in a stand-by state, the switching unit 7 is operated so as to connect the charger 6 to the secondary power supply unit 4 so that the capacitor C of the secondary power supply unit 4 is charged. In the case of heating the heating part 2 in the heating unit 1 in this state, the main switch 5 is switched on so that power is supplied from the primary power supply unit 3 to the primary heating element 2*a*, and at the same time, the switching unit 7 is operated so that power is supplied from the secondary power supply unit 4 to the secondary heating element 2*b*, thereby supplying high power to the heating part 2. Thus, at the time of starting the heating of the heating part 2, both the primary power supply unit 3 and the secondary power supply unit 4 supply high power to the heating part 2. Accordingly, the heating part 2 can be started up and raised to a predetermined temperature in a short period of time, and the surface temperature of the fixing roller 40 can be raised to a predetermined fixing temperature rapidly. The heating part 2 may include a plurality of secondary heating elements.

When a predetermined period of time passes after the secondary power supply unit 4 starts the heating of the secondary heating elements 2*b* of the heating part 2 by supplying power thereto, the controller 8 shuts off the power supply from the secondary power supply unit 4 to the secondary heating element 2*b* to prevent the overheating of the heating part 2, and maintains the heating part 2 at a predetermined temperature. The power supplied from the secondary power unit 4 to the secondary heating element 2*b* decreases with the passage of time after the supplying of the power is started. In accordance with this decrease in the supplied power, a time to shut off the power supply from the secondary power supply unit 4 to the secondary heating element 2*b* is determined, and the power supply from the secondary power supply unit 4 to the secondary heating element 2*b* is shut off when the supplied power has somewhat decreased. As a result, the degradation of the components of peripheral circuits and the generation of electromagnetic noise that occur at the time of shutting off high power supply can be prevented.

When the power supplied from the secondary power supply unit 4 to the secondary heating element 2*b* is shut off, the secondary power supply unit 4 is in an undercharged state. Therefore, when the temperature of the heating part 2 is stable and the heating part 2 does not consume power relatively, the switching unit 7 is switched to the charger 6 side so as to connect the charger 6 to the secondary power supply unit 4 so that the secondary power supply unit 4 is charged with power supplied from the primary power supply unit 3. When the heating part 2 requires another supply of high power, the secondary power supply unit 4 as well as the primary power supply unit 3 supplies power to the heating part 2 so that the heating part 2 is supplied with a large quantity of energy.

When the above-described image-forming apparatus is in operation, performing image-forming operations, an abnormality such as a crash or a paper jam may occur so that the image-forming apparatus stops or suspends its operation. According to this embodiment, if there is a situation allowing the capacitor C to be charged even in this state, the capacitor is charged, even if intermittently, so that an excellent image can be formed.

That is, when the image-forming operation of the image-forming apparatus is stopped or suspended by an abnormality such as a crash or a paper jam, but the image-forming apparatus can resume normal operation (or can return to its operating state) by a user's operation such as the removing of a jammed recording medium P or the shutting off and restoring of power supply, there is a situation allowing the capacitor C to be charged. Therefore, at this point, such control is performed that the capacitor is charged in accordance with its remaining stored energy.

Figure 4:
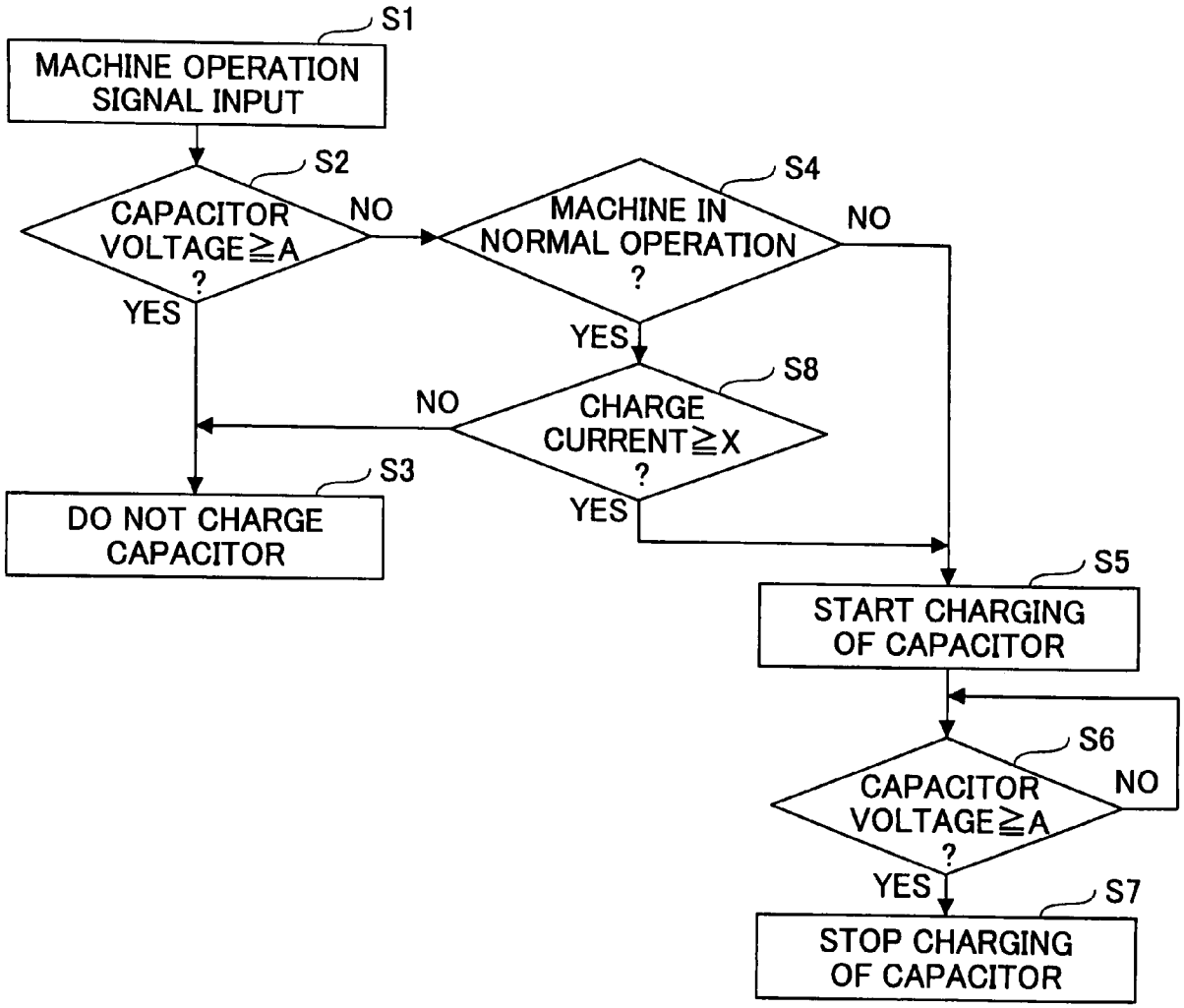
FIG. 4 is a flowchart of the operation of charging a capacitor according to the embodiment of the present invention.

FIG. 4 is a flowchart of the above-described operation of charging the capacitor C. In step S1 of FIG. 4, a machine operation signal is input. Then, in step S2, the remaining stored energy of the capacitor C is determined based on its voltage. That is, it is determined whether the voltage of the capacitor C is higher than or equal to a predetermined voltage A, which is a threshold that may be set to an optimum or preferable value in terms of design. If the capacitor C shows a voltage higher than or equal to the predetermined voltage A (that is, "YES" in step S2), in step S3, this operation ends without charging the capacitor C. If the capacitor C shows a voltage lower than the predetermined voltage (that is, "NO" in step S2), in step S4, it is determined whether the image-forming apparatus is in normal operation. If it is determined that the image-forming apparatus is not in normal operation (that is, "NO" in step S4), in step S5, the controller 8 starts to control the charging of the capacitor C. Then, in step S6, it is determined whether the voltage of the capacitor C is higher than or equal to the predetermined voltage A. If it is determined that the voltage of the capacitor C is higher than or equal to the predetermined voltage A (that is, "YES" in step S6), in step S7, the controller 8 causes the charging of the capacitor C to be stopped. If it is determined that the voltage of the capacitor C is lower than the predetermined voltage A (that is, "NO" in step S6), the controller 8 causes the charging of the capacitor C to be continued until the voltage of the capacitor C is higher than or equal to the predetermined voltage A. If it is determined in step S4 that the image-forming apparatus is in normal operation (that is, "YES" in step S4), in step S8, it is determined whether a charge current larger than a predetermined value X can be secured. If a charge current larger than a predetermined value X can be secured (that is, "YES" in step S8), the operation proceeds to steps S5 through S7. If a charge current larger than a predetermined value X cannot be secured (that is, "NO" in step S8), in step S3, the operation ends without charging the capacitor C.

In step S1 of FIG. 4, the machine operation signal, based on which the determinations of the subsequent steps are made, is defined as a signal indicating that the image-forming apparatus is in operation as a machine or the image-forming apparatus can resume normal operation (or can return to its operating state) even if its operation is suspended or stopped for a certain reason. This makes it possible to condition the above-described operation of FIG. 4 to be performable when the state of the suspended or stopped image-forming operation allows returning to the image-forming operation. In order to perform the above-described operation, voltage and current values may be detected by detectors such as voltmeters and ammeters. Further, it is possible to make use of elapsed time after the start of the charging of the capacitor C in the secondary power supply unit 4 by using a timer.

The object of application of the present invention is not limited to the graphically represented type of image-forming apparatus. The present invention is also applicable to image-forming apparatuses of various types such as those using a belt-type photosensitive body instead of a drum-like photosensitive body and those of a color type using an intermediate transfer belt.

According to the present invention, if a situation allows the capacitor C of the secondary power supply unit 4 of the fixing unit 36 to be charged, as in the case where the image-forming apparatus stops or suspends its operation due to a detected abnormality such as a paper jam while the image-forming apparatus is in operation, the capacitor C is charged, even if intermittently. This makes it possible to form an excellent image while the image-forming apparatus is in use. Further, this also makes it possible to prevent the stored energy of the capacitor C from decreasing due to repeated image-forming operations each with a small number of paper sheets passing through the fixing unit 36.

The present invention is not limited to the specifically disclosed embodiment, and variations and modifications may be made without departing from the scope of the present invention.

The present application is based on Japanese priority patent application No. 2003-087235, filed on Mar. 27, 2003, the entire contents of which are hereby incorporated by reference.

What is claimed is:

1. An image forming apparatus, comprising:

a fixing unit including a heating element;

a power storage unit configured to supply power to the image-forming apparatus; and a controller configured to control an operation of the power storage unit, wherein, when image-forming operation of the image-forming apparatus is suspended, the controller performs control such that the power storage unit is charged when a remaining amount of stored energy thereof is lower than a predetermined voltage and is prevented from being charged when the remaining amount of stored energy is higher than or equal to the predetermined voltage.

2. The image-forming apparatus as claimed in claim 1, wherein the power storage unit comprises a capacitor.

3. The image-forming apparatus as claimed in claim 1, wherein the power storage unit is charged when the image-forming operation of the image-forming apparatus is suspended by an abnormality.

* * * * *